US008776822B2

(12) United States Patent
McIntire

(10) Patent No.: US 8,776,822 B2
(45) Date of Patent: Jul. 15, 2014

(54) INFLOW PROTECTION DEVICE FOR AIR RELIEF VALVES ON WATER-CARRYING PIPELINES

(75) Inventor: Mark McIntire, Riverside, MO (US)

(73) Assignee: Odor Control Specialties, LLC, Kansas City, MO (US)

( * ) Notice: Subject to any disclaimer, the term of this patent is extended or adjusted under 35 U.S.C. 154(b) by 180 days.

(21) Appl. No.: 13/560,772

(22) Filed: Jul. 27, 2012

(65) Prior Publication Data

US 2014/0026979 A1 Jan. 30, 2014

(51) Int. Cl.
*F16K 24/04* (2006.01)
*E03F 5/08* (2006.01)
*E03F 1/00* (2006.01)

(52) U.S. Cl.
CPC .. *E03F 5/08* (2013.01); *E03F 1/006* (2013.01)
USPC ..... 137/199; 137/363; 137/493.9

(58) Field of Classification Search
CPC ..... E03F 5/08; E03F 1/006
USPC ..... 137/171, 197, 199, 207, 362–373, 493, 137/493.8, 493.9; 52/20, 21
See application file for complete search history.

(56) References Cited

U.S. PATENT DOCUMENTS

| | | | | |
|---|---|---|---|---|
| 1,902,046 | A * | 3/1933 | Raines | 137/493.8 |
| 2,666,445 | A * | 1/1954 | Cronkhite | 137/198 |
| 3,017,895 | A * | 1/1962 | Portner | 137/115.25 |
| 4,815,492 | A * | 3/1989 | Tedei | 137/362 |
| 5,613,513 | A | 3/1997 | Makowan | |
| 7,866,334 | B2 | 1/2011 | McIntire | |
| 2006/0283505 | A1 * | 12/2006 | Makowan et al. | 137/388 |
| 2007/0033719 | A1 * | 2/2007 | McIntire | 4/219 |

* cited by examiner

*Primary Examiner* — Craig Schneider
*Assistant Examiner* — Craig J Price
(74) *Attorney, Agent, or Firm* — Hovey Williams LLP

(57) ABSTRACT

An inflow protection device for preventing liquids and other contaminants from entering a water-carrying pipeline through an air valve connected to the pipeline. The inflow protection device includes an adaptor and an elongated vent pipe. The adaptor has a first end for coupling with an outlet of the air valve and second end. The vent pipe has a first end configured for directly or indirectly coupling with the second end of the adaptor and a second end extending out of and above a vault in which the air valve is installed. The vent pipe is of a length sufficient to position its second end above a flood plain level so that the second end allows air to be exhausted from and admitted into the air valve even when the vault in which the air valve is located becomes flooded.

20 Claims, 2 Drawing Sheets

INFLOW PROTECTION DEVICE FOR AIR RELIEF VALVES ON WATER-CARRYING PIPELINES

BACKGROUND

Pipelines such as those in water and wastewater treatment systems are subject to unwanted air build-up and vacuum conditions that can interfere with the proper flow of water or other liquids through the pipelines. Air/vacuum valves, air release valves, and combination-type air valves are commonly installed on pipelines to prevent such air and vacuum related problems. These air valves are typically installed below grade in concrete vaults to protect the valves and the pipelines from freezing. This creates a problem because water can accumulate in the vaults during heavy rain and flooding and enter the pipelines through the air valves, thus contaminating the potable water in the pipelines.

Inflow protection devices have been developed to prevent flood water and other contaminates from entering pipelines through air valves. However, known inflow protection devices incorporate multiple float valves, check valves, etc. and are therefore complicated, expensive, and difficult to install and maintain. Moreover, known inflow protection devices are not testable or certifiable and therefore do not meet EPA, USC, or ASSC specifications for cross connection protection.

SUMMARY

The present invention solves at least some of the above-described problems and provides a distinct advance in the art of inflow protection devices for water-carrying pipelines. More particularly, the present invention provides an inflow protection device that prevents water and other contaminates from entering a pipeline through an air valve without the use of additional float valves, check valves, etc. The inflow protection device also permits the air valve to continue admitting air into and exhausting air from the pipeline even when the vault is flooded.

An embodiment of the inflow protection device is designed to be connected to an air valve on a pipeline. The pipeline may carry water or any other liquid, preferably extends through an underground vault, and may be part of a larger system such as a water distribution system or a wastewater system. In one embodiment, the inflow protection device is designed for use with a combination-type air valve that includes a larger air/vacuum valve and a smaller air release valve.

An embodiment of the inflow protection device broadly comprises an adaptor, a flexible hose, and an elongated vent pipe. The components of the inflow protection device may be formed of any suitable materials and may be sized for any air valve and/or pipeline.

The adaptor may be formed from a short piece of pipe with male pipe threads at both ends and has a first end that may be coupled with the outlet of the air/vacuum valve and a second end that connects with the flexible hose. The adaptor may be sized to connect with any sized air valve. The adaptor 28 may also include an air nozzle that is coupled with the output of the air release valve via a piece of copper tubing or other air tube. This permits the air release valve to discharge air to the adaptor and other components of the inflow protection device as described below.

The flexible hose connects the adaptor to a wall pipe extending though the upper surface of the vault. Quick connect hose fittings may be attached to the ends of the hose. The quick connect fittings, as well as the flexible nature of the hose, allow an installer to more easily assemble and install the inflow protection device within the confined space of the vault.

The vent pipe connects the air valve, the adaptor, and the flexible hose to ambient air outside the vault to permit air to be exhausted from and admitted into the pipeline. Advantageously, the vent pipe exhausts air from and admits air into the air valve even when the vault is filled with water without allowing any water from the vault to enter the air valve. The vent pipe is of a length sufficient to position its upper end above a flood plain level so that it allows air to be exhausted from and admitted into the air valve even when the vault becomes flooded. For example, if the 100 year flood plain is 1 foot above the top of the vault, the vent pipe may be sized to extend approximately 2 feet above the vault. An embodiment of the vent pipe includes a 180 degree bend so that its second end points downwardly. This prevents rain from entering the vent pipe. A screen may be positioned in or over the second end of the vent pipe to prevent animals from nesting in the vent pipe or other objects from entering the vent pipe.

This summary is provided to introduce a selection of concepts in a simplified form that are further described in the detailed description below. This summary is not intended to identify key features or essential features of the claimed subject matter, nor is it intended to be used to limit the scope of the claimed subject matter. Other aspects and advantages of the present invention will be apparent from the following detailed description of the embodiments and the accompanying drawing figures.

BRIEF DESCRIPTION OF THE DRAWING FIGURES

Embodiments of the present invention are described in detail below with reference to the attached drawing figures, wherein.

Figure 1:
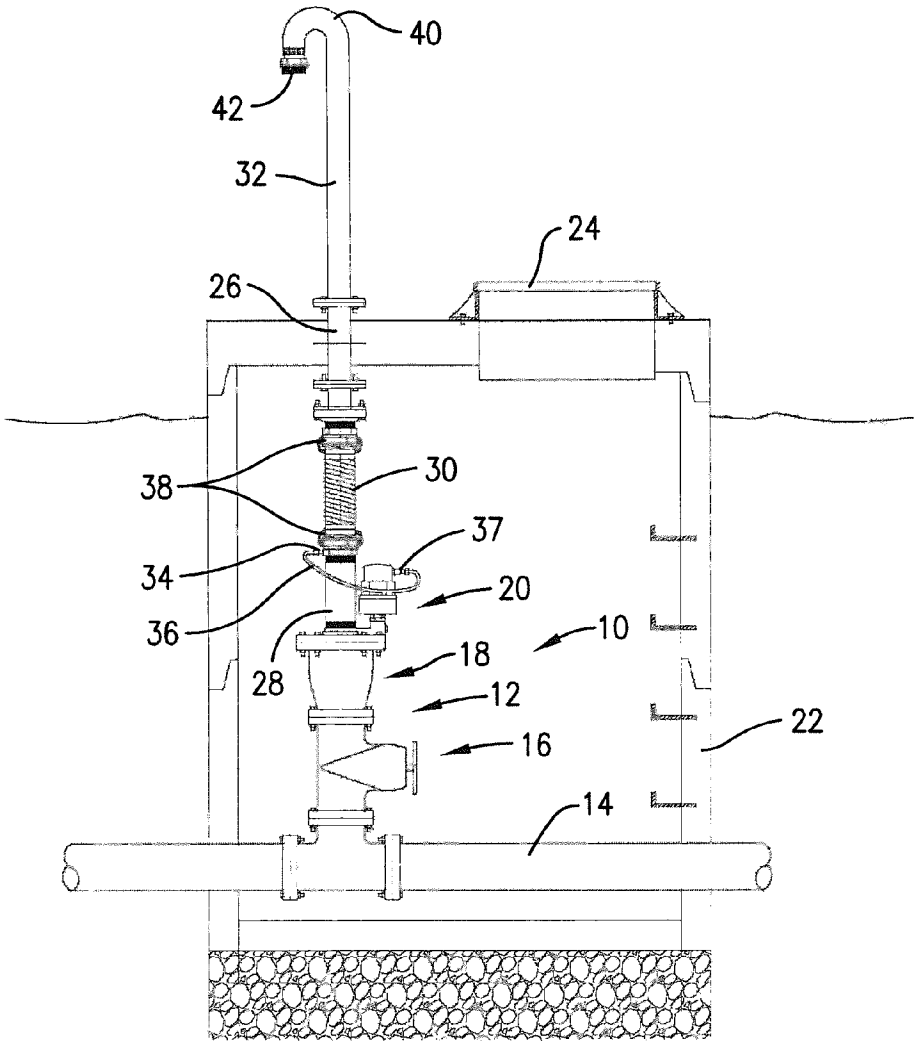
FIG. 1 is an elevational view of an inflow protection device constructed in accordance with an embodiment of the present invention shown installed on an air valve of a water-carrying pipeline.
Figure 2:
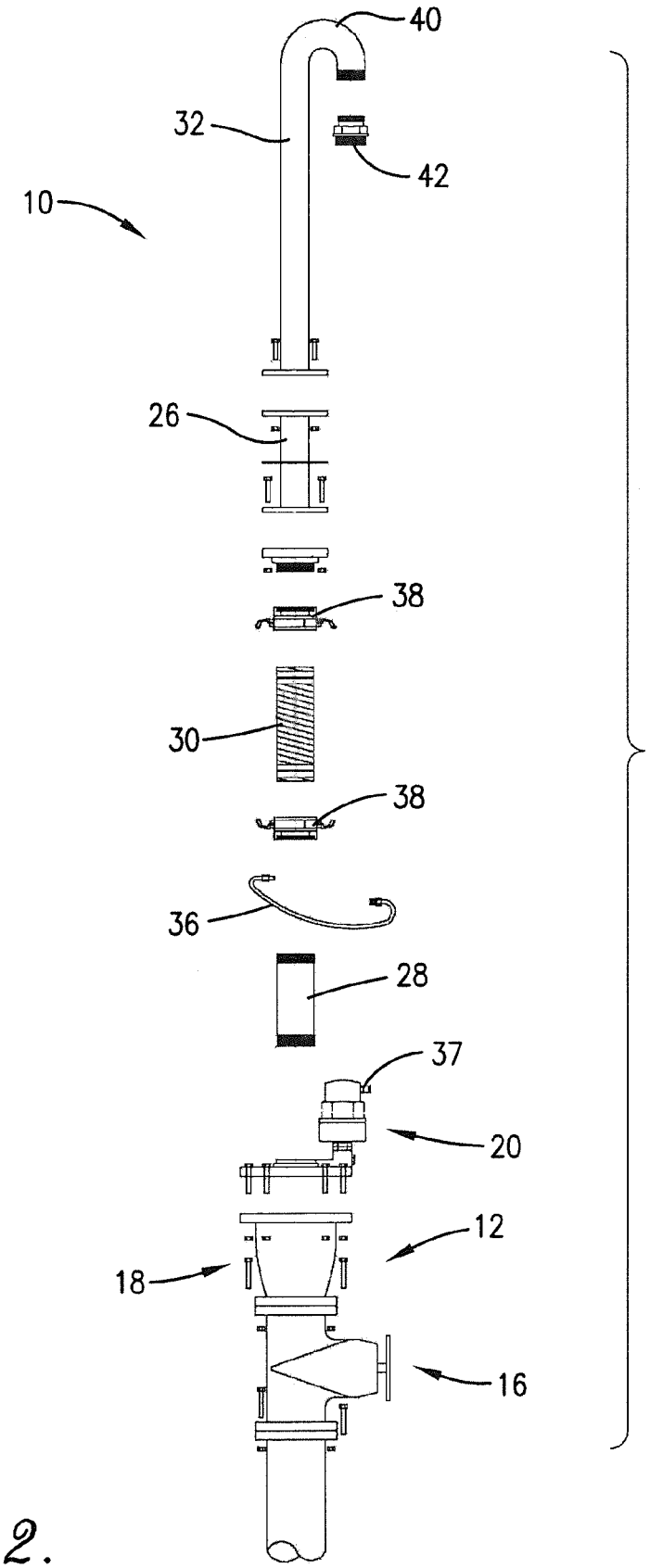
FIG. 2 is an exploded view of the components of the inflow protection device.

The drawing figures do not limit the present invention to the specific embodiments disclosed and described herein. The drawings are not necessarily to scale, emphasis instead being placed upon clearly illustrating the principles of the invention.

DETAILED DESCRIPTION

The following detailed description of embodiments of the invention references the accompanying drawings. The embodiments are intended to describe aspects of the invention in sufficient detail to enable those skilled in the art to practice the invention. Other embodiments can be utilized and changes can be made without departing from the scope of the claims. The following detailed description is, therefore, not to be taken in a limiting sense. The scope of the present invention is defined only by the appended claims, along with the full scope of equivalents to which such claims are entitled.

In this description, references to "one embodiment", "an embodiment", or "embodiments" mean that the feature or features being referred to are included in at least one embodiment of the technology. Separate references to "one embodiment", "an embodiment", or "embodiments" in this description do not necessarily refer to the same embodiment and are also not mutually exclusive unless so stated and/or except as will be readily apparent to those skilled in the art from the description. For example, a feature, structure, act, etc. described in one embodiment may also be included in other embodiments, but is not necessarily included. Thus, the present technology can include a variety of combinations and/or integrations of the embodiments described herein.

An inflow protection device 10 constructed in accordance with embodiments of the present invention is shown in the drawings figures. The inflow protection device 10 is designed to be connected to an air valve 12 on a liquid carrying pipeline 14. The liquid carrying pipeline may carry water or any other liquid and may be part of a larger system such as a water distribution system or a wastewater system.

The air valve 12 may be connected to the pipeline by a gate valve, knife gate valve or other valve 16. The air valve 12 exhausts air from and introduces air into the pipeline 14 to prevent unwanted air build-up and vacuum conditions in the pipeline. The air valve may be an air/vacuum valve, an air release valve, or a combination-type air valve. As used herein, the term "air valve" is meant to encompass any device that exhausts air from and/or admits air into the pipeline.

In one particular embodiment of the invention, the air valve 12 is a combination-type air valve having a larger air/vacuum valve 18 and a smaller air release valve 20. The air/vacuum valve 18 exhausts large quantities of air from the pipeline 14 during filling of the pipeline with water or other liquids and admits large quantities of air into the pipeline during draining of the pipeline. The smaller air release valve 20 exhausts similar quantities of air entrapped in liquid in the pipeline while the pipeline is operating under pressure. The larger air/vacuum valve 18 and smaller air release valve 20 may be housed within a single body or two separate bodies as shown.

The water pipeline 14 and air valve 12 are typically positioned below grade to prevent freezing. In one embodment, the air valve 12 is positioned in a buried vault 22 or other enclosure. As shown, a section of the pipeline 14 passes through the vault 22 to allow installation of the air valve 12 and inflow protection device 10 on the pipeline. The vault 22 may include a manhole cover 24 for permitting access for maintenance and repair purposes. A wall pipe 26 may extend through a top surface of the vault for connecting to portions of the inflow protection device 10 as explained in more detail below.

Because the vault 22 is below grade, it can fill with water and contaminates during heavy rains and/or flooding. This is a problem because water that accumulates in the vault can enter the pipeline 14 through the air valve 12 and contaminate the water or other liquids in the pipeline. The inflow protection device 10 of the present invention prevents this from occurring by preventing liquids and other contaminants from entering the air valve 12 while also permitting the air valve to continue to exhaust air from and admit air into the pipeline. Advantageously, the inflow protection device achieves this without additional float valves, check valves, and other devices that require ongoing maintenance, repair, and replacement.

An embodiment of the inflow protection device 10 broadly comprises an adaptor 28, a flexible hose 30, and an elongated vent pipe 32. The components of the inflow protection device may be formed of any suitable materials and may be sized for any air valve 12 and/or pipeline 14.

The adaptor 28 connects the outlet of the air valve 12 to the remaining components of the inflow protection device 10. An embodiment of the adaptor is formed from a nipple, or a short piece of pipe with male pipe threads at both ends, and has a first end that may be coupled with the outlet of the air/vacuum valve 18 and a second end that connects with the flexible hose 30. The adaptor may be sized to connect with any sized air valve, and in one embodiment, is approximately 3-12 inches in diameter.

An air nozzle 34 may be formed in the adaptor 28. The air nozzle 34 is coupled with the output of the air release valve 20 via a piece of copper tubing 36 or other air line. This permits the air release valve to discharge air to the adaptor and other compenents of the inflow protection device as described below. A UL check valve 37 may be attached to the air release valve 20 as shown.

The flexible hose 30 connects the adaptor 28 to the wall pipe 26 extending though the upper surface of the vault 22. The hose 30 may be formed from rubber and may be sized to accommodate any sized vault. In one embodiment, the hose 30 is approximately 3-12 inches in diameter and 3-6 feet in length. Quick connect hose fittings 38 or cam locks may be attached to the ends of the hose. The quick connect fittings 38, as well as the flexible nature of the hose, allow an installer to more easily assemble and install the inflow protection device 10 within the confined space of the vault.

The vent pipe 32 connects the air valve 12, the adaptor 28, and the flexible hose 30 to ambient air outside the vault 32 to permit air to be exhausted from and admitted into the pipeline 14. Advantageously, the vent pipe 32 exhausts air from and admits air into the air valve even when the vault is filled with water without allowing any water from the vault to enter the air valve.

An embodiment of the vent pipe 32 may be formed of PVC or metal piping and has a lower end configured for directly or indirectly coupling with the wall pipe 26 and an upper end extending above the vault. The vent pipe is of a length sufficient to position its upper end above a flood plain level so that the second end allows air to be exhausted from and admitted into the air valve even when the vault becomes flooded. For example, if the 100 year flood plain is 1 foot above the top of the vault, the vent pipe may be sized to extend approximately 2 feet above the vault. In other embodiments, the vent pipe 32 may be 5 feet, 10 feet, or even longer so as to extend above nearly any flood plain regardless of the particular position of the vault.

An embodiment of the vent pipe 32 includes a 180 degree bend 40 so that its upper end points downwardly as illustrated. This prevents rain from entering the vent pipe. A screen 42 may be positioned in or over the second end of the vent pipe to prevent animals from nesting in the vent pipe or other objects from entering the vent pipe.

The inflow protection device 10 may be installed as follows. First, the adaptor 28 is threaded into or otherwise connected to the outlet of the air/vacuum valve 18. The outlet of the air release valve 20 is then connected to the air nozzle 34 on the adaptor by copper tubing, a rubber hose, or any other air conduit 36. Next, the flexible hose 30 is connected between the adaptor 28 and the bottom of the wall pipe 26 with the quick connect hose fittings 38. Finally, the vent pipe 32 is bolted to or otherwise coupled with the top of the wall pipe 26. Although not described and illustrated herein, seals, gaskets, etc may be inserted between all the connection points of the inflow protection device.

In operation, air is discharged from the air/vacuum valve 18 and out the vent pipe 32 whenever the pipeline 14 is being filled with water or other liquids. Conversely, air is admitted into the air/vacuum valve 18 via the vent pipe 32 whenever the pipeline 14 is being drained. When the pipeline 14 is full and under pressure, air entrained in the water may exit the pipeline via the air release valve 20. If the vault floods or otherwise becomes filled with water, the inflow protection device 10 prevents water from entering the air/vacuum valve 18 or the air release valve 20 as long as the upper end of the vent pipe is above standing water level.

Although the invention has been described with reference to the embodiments illustrated in the attached drawing figures, it is noted that equivalents may be employed and substitutions made herein without departing from the scope of the invention as recited in the claims. For example, the particular sizes and shapes of the components of the inflow protection device may be changed without altering the scope of the invention.

Having thus described the preferred embodiment of the invention, what is claimed As new and desired to be protected by Letters Patent includes the following:

1. An inflow protection device for preventing liquids and other contaminants from entering a water-carrying pipeline through an air valve connected to the pipeline, the inflow protection device comprising:

an adaptor having a first end for coupling with an outlet of the air valve and a second end, the adaptor further having an air nozzle for coupling with an air line attached to an air release valve; and an elongated vent pipe having a first end configured for directly or indirectly coupling with the second end of the adaptor and a second end extending out of and above a vault in which the air valve is installed, wherein the vent pipe is of a length sufficient to position the second end of the vent pipe second end above a flood plain level so that the second end of the vent pipe allows air to be exhausted from and admitted into the air valve even when the vault in which the air valve is located becomes flooded.

2. The inflow protection device as set forth in claim 1, wherein the air valve is an air/vacuum valve, or a combination-type air valve.

3. The inflow protection device as set forth in claim 1, further comprising a flexible hose for coupling between the adaptor and the vent pipe.

4. The inflow protection device as set forth in claim 3, further comprising a wall pipe installed within a cover of the vault for connection between the flexible hose and the vent pipe.

5. The inflow protection device as set forth in claim 4, further comprising quick connects coupled to ends of the flexible hose for facilitating connection of the flexible hose between the adaptor and the wall pipe.

6. The inflow protection device as set forth in claim 1, wherein the vent pipe includes a bend so that the second end of the vent pipe points downwardly to prevent rain from entering the vent pipe.

7. The inflow protection device as set forth in claim 1, further comprising a screen positioned in or over the second end of the vent pipe to prevent objects from entering the vent pipe.

8. The inflow protection device as set forth in claim 1, wherein the vent pipe is at least 2 feet long so that the second end of the vent pipe is about 2 feet above grade.

9. The inflow protection device as set forth in claim 1, wherein the vent pipe is at least 5 feet long so that the second end of the vent pipe is about 5 feet above grade.

10. An inflow protection device for preventing liquids and other contaminants in a below-ground vault from entering a water-carrying pipeline through an air valve connected to the pipeline, the air valve having an air/vacuum valve for exhausting and admitting large quantities of air into and out of the pipeline and an air release valve for exhausting air previously entrapped in liquid in the pipeline, the inflow protection device comprising:

an adaptor having a first end and a second end, wherein the first end is for coupling with an outlet of the air/vacuum valve, the adaptor further having an air nozzle for coupling with an air line attached to an air release valve;

a flexible hose having a first end and a second end, wherein the first end is for coupling with the second end of the adaptor and the second end is for coupling with a wall pipe extending through a top surface of the vault; and an elongated vent pipe having a first end configured for directly or indirectly coupling with the wall pipe and a second end extending above the vault, wherein the vent pipe is of a length sufficient to position the second end of the vent pipe end above a flood plain level so that the second end of the vent pipe allows air to be exhausted from and admitted into the air valve even when the vault in which the air valve is located becomes flooded.

11. The inflow protection device as set forth in claim 10, further comprising quick connects coupled to the ends of the flexible hose for facilitating connection of the flexible hose between the adaptor and the wall pipe.

12. The inflow protection device as set forth in claim 10, wherein the vent pipe includes a bend so that the second end of the vent pipe end points downwardly to prevent rain from entering the vent pipe.

13. The inflow protection device as set forth in claim 10, further comprising a screen positioned in or over the second end of the vent pipe to prevent objects from entering the vent pipe.

14. The inflow protection device as set forth in claim 10, wherein the vent pipe is at least 2 feet long so that the second end of the vent pipe is about 2 feet above grade.

15. The inflow protection device as set forth in claim 10, wherein the vent pipe is at least 5 feet long so that the second end of the vent pipe is about 5 feet above grade.

16. An air/vacuum release assembly for a water pipeline that runs through an underground vault, the air/vacuum release assembly comprising:

a combination-type air valve for coupling with a valve on the water pipeline for exhausting air from and introducing air into the water pipeline, the combination-type air valve having an air/vacuum valve for exhausting and admitting large quantities of air into and out of the pipeline and an air release valve for exhausting air previously entrapped in liquid in the pipeline; and an inflow protection device for preventing liquids and other contaminants from entering the water pipeline through the combination-type air valve, the inflow protection device comprising:

an adaptor having a first end and a second end, wherein the first end is for coupling with an outlet of the air/vacuum valve, the adaptor further having an air nozzle for coupling with an air line attached to the air release valve;

a flexible hose having a first end and a second end, wherein the first end is for coupling with the second end of the adaptor and the second end is for coupling with a wall pipe extending through a top surface of the vault; and an elongated vent pipe having a first end configured for directly or indirectly coupling with the wall pipe and a second end extending above the vault, the vent pipe being of a length sufficient to position its second end above a flood plain level so that the second end allows air to be exhausted from and admitted into the air valve even when the vault in which the air valve is located becomes flooded.

17. The inflow protection device as set forth in claim 16, further comprising quick connects coupled to the ends of the flexible hose for facilitating connection of the flexible hose between the adaptor and the wall pipe.

18. The inflow protection device as set forth in claim 16, wherein the vent pipe includes a bend so that the second end of the vent pipe end points downwardly to prevent rain from entering the vent pipe.

19. The inflow protection device as set forth in claim 16, further comprising a screen positioned in or over the second end of the vent pipe to prevent objects from entering the vent pipe.

20. The inflow protection device as set forth in claim 16, wherein the vent pipe is at least 2 feet long so that the second end of the vent pipe is almost 2 feet above grade.

* * * * *